United States Patent [19]

Black

[11] 3,973,490

[45] Aug. 10, 1976

[54] ROCKER PRESS WITH SQUEEGEE AND WEB FEED MEANS

[76] Inventor: James A. Black, 13700 Sparta Ave., Kent City, Mich. 49330

[22] Filed: Oct. 3, 1974

[21] Appl. No.: 511,784

[52] U.S. Cl. ..... 101/124; 101/126; 226/95

[51] Int. Cl.[2] ..... B41F 15/08; B41F 15/24

[58] Field of Search ..... 101/123, 126, 129, 124, 101/114, 115, 407 R, 407 BP; 226/95

[56] References Cited

UNITED STATES PATENTS

| | | | |
|---|---|---|---|
| 2,881,698 | 4/1959 | Graham | 101/123 |
| 2,895,412 | 7/1959 | Reed | 101/126 X |
| 2,918,866 | 12/1959 | Reed | 101/124 |
| 3,679,112 | 7/1972 | Black et al. | 226/3 |
| 3,731,623 | 5/1973 | Bubley et al. | 101/123 X |
| 3,780,652 | 12/1973 | Black et al. | 101/124 |

*Primary Examiner*—J. Reed Fisher
*Assistant Examiner*—R. E. Suter
*Attorney, Agent, or Firm*—Price, Heneveld, Huizenga & Cooper

[57] ABSTRACT

A stencil screen printing press especially suitable for web stock, employing a stencil frame that rocks back and forth over a curved bed in a controlled relation to retractable web register means and to web directional control and advancing means.

2 Claims, 14 Drawing Figures

FIG. D

ROCKER PRESS WITH SQUEEGEE AND WEB FEED MEANS

BACKGROUND OF THE INVENTION

This invention relates to stencil screen printing, and more particularly to curvalinear stencil screen printing apparatus particularly suited for repeat printing on a web.

Ability to stencil print repeat patterns on a generally continuous web enables total printing cost per item to be significantly reduced and enables production output to be increased. Equipment to effectively achieve stencil printing on web stock is set fourth in U.S. Pat. No. 3,779,160. Such equipment reciprocates the stencil and its frame over the print surface an amount slightly greater than twice the length of the area to be printed. Consequently, the practical size of the area to be printed is limited. Above a certain size, the large reciprocating stencil frame necessary would require too much valuable space for its reciprocal movement. Also, the large heavy stencil frame becomes unwieldy to reciprocate. And, if the structure were strengthened to support it, still the speed of printing would be lessened due to the necessity to more slowly reciprocate the heavier stencil frame. The heavier the frame, the heavier is the driving and braking equipment required to repeatedly accelerate it, stop it, accelerate it in the opposite direction, stop it, and so forth. Therefore, to print large items is normally not practical or, if done, involves printing of segments thereof to be subsequently assembled, e.g. as with large posters.

Achieving high quality when using very large stencils on a flat bed press presents other problems. The large stencil tends to sag at the center, so that, after the print stroke, the separation of the stencil screen from the stock too frequently is not a neat separation, causing distortion of some freshly printed areas. And the ink tends to puddle at the center of the screen.

SUMMARY OF THE INVENTION

An object of this invention is to provide a curvalinear stencil printing apparatus especially capable of accurate repeat high quality printing on continuous web stock. Multiple colors can be printed in sequence in accurate registry, even with large stencils. A rocking stencil frame on a curved bed functions in special relation with a cooperative retracting web register mechanism. Printing rates can be significantly increased over presses employing a reciprocating stencil frame. Large accurate prints can be made without using excess floor space. Web stock as for draperies and the like can be economically printed on a practical basis.

Another object of this invention is to provide a curvalinear bed, stencil screen web printer that combines web advancing guide belts oriented to advance the web stock over the curved bed in constantly controlled orientation. The web is advanced in specially controlled relation to the rocking forward and return motion of the screen frame and in specially controlled relation to web registration.

These and other objects, advantages, and features of the invention will be apparent upon studying the following description and drawings.

BRIEF DESCRIPTION OF THE DRAWINGS

FIGS. 7A, 7B, 7C, 7D, and 7E constitute a series of schematic diagrams showing the sequence of operational steps during the operation of the apparatus;

DESCRIPTION OF THE PREFERRED EMBODIMENT

Figure 1:
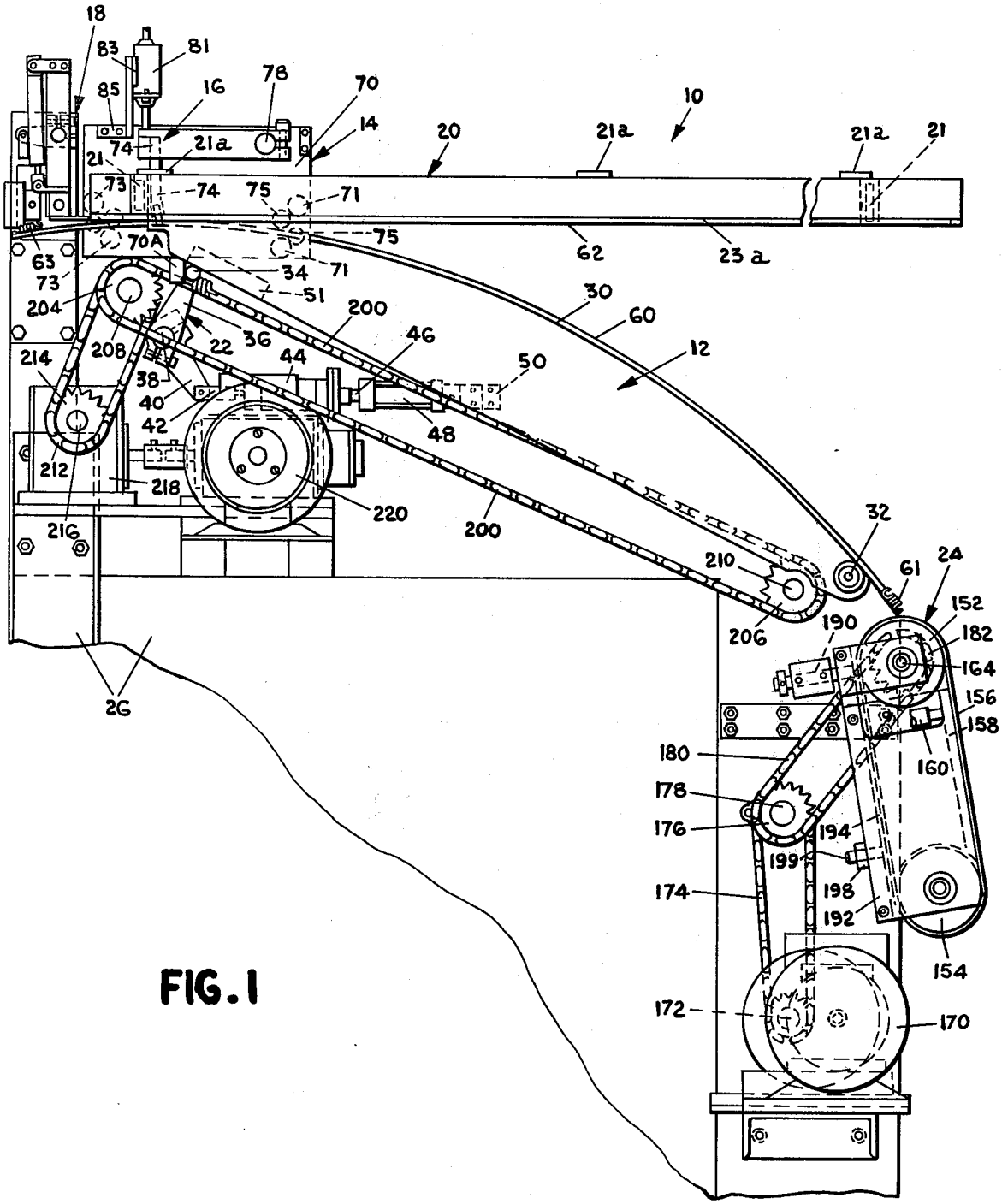
FIG. 1 is a side elevational view of the printing apparatus.

Referring now specifically to the drawings, the complete stencil printing apparatus 10 includes a main supporting framework 26; a vertically shiftable, curved, support bed subassembly 12; straddled by a spaced pair of similarly curved, fixed guide tracks 13; a traveling print carriage subassembly 14, containing a squeegee subassembly 16; web registration subassembly 18; a rocking stencil screen frame support subassembly 20, which mounts a removable stencil screen frame 21; bed elevation control subassembly 22 for bed subassembly 12; and web advancing subassembly 24 at the discharge end of the bed.

Bed subassembly 12 includes an arcuately curved upper support surface 30 (see phantom lines in FIG. 8) extending from a generally horizontal infeed upper end (left end as depicted in FIG. 1) to a downwardly sloping outfeed lower end (right end in FIG. 1), the curvature extending through an angle of approximately 90 degrees. The web feed stock W to be printed is intermittently fed from the upper end over support surface 30, to the lower end where it is discharged.

Bed 12 is pivotally mounted at its lower end on a transverse pivot shaft 32 (FIG. 1). The upper infeed end of the bed includes a pair of support plate members 51 to rest upon shiftable support roller elements 34. Elements 34 are on the upper end of a pair of pivotal levers or links 36, which have their lower ends in turn fixedly mounted to a pivot shaft 38. Also secured to shaft 38 is a pivotal link 40, at its upper end, the opposite lower end of which is pivotally secured to the protruding rod 42 of a fluid cylinder 44. The opposite end of fluid cylinder 44 is secured to the protruding rod 46 of cylinder 48 which has its opposite end fixedly attached at bracket 50 to the framework for the assembly. This linkage forms a type of cam assembly, as will be understood. Actuation of one of cylinders 48 and 44, specifically 48, shifts elements 34 to raise and lower the bed 12 about pivot 32 during the respective print and return strokes (FIGS. 7A–7E). Actuation of both cylinders 44 and 48 shifts elements 34 a greater amount to raise and lower the bed 12 a greater amount as for cleaning or the like of the apparatus.

More specifically, extension of cylinder 48 shifts link 40 clockwise, (as the apparatus is set forth in FIG. 1) to thereby shift links 36 clockwise, moving elements 34 to the right (FIG. 1) along members 51, which allows bed 12 to drop about one-half inch or so to lower surface 30 away from the print screen. Contraction of cylinder 48 and 44 48 raises the bed for the print stroke. Actuation of both cylinders lowers the bed 12 a greater amount to allow a person's hands to enter between surface 30 and the overlying print subassemblies to clean the underside of the stencil screen.

The pair of tracks 13 are fixed to the framework 26 astraddle bed 12, so that when bed 12 drops, the tracks do not drop with it. Print carriage subassembly 14 travels back and forth along these tracks, and is interconnected with stencil frame support 20 to rock it back and forth during this travel. Tracks 13 are positioned relative to bed 12 such that, when the bed is fully elevated to the print position, the stencil screen and squeegee will be in printing relation to the web stock resting on surface 30, as will be understood from the description to follow.

Figure 2:
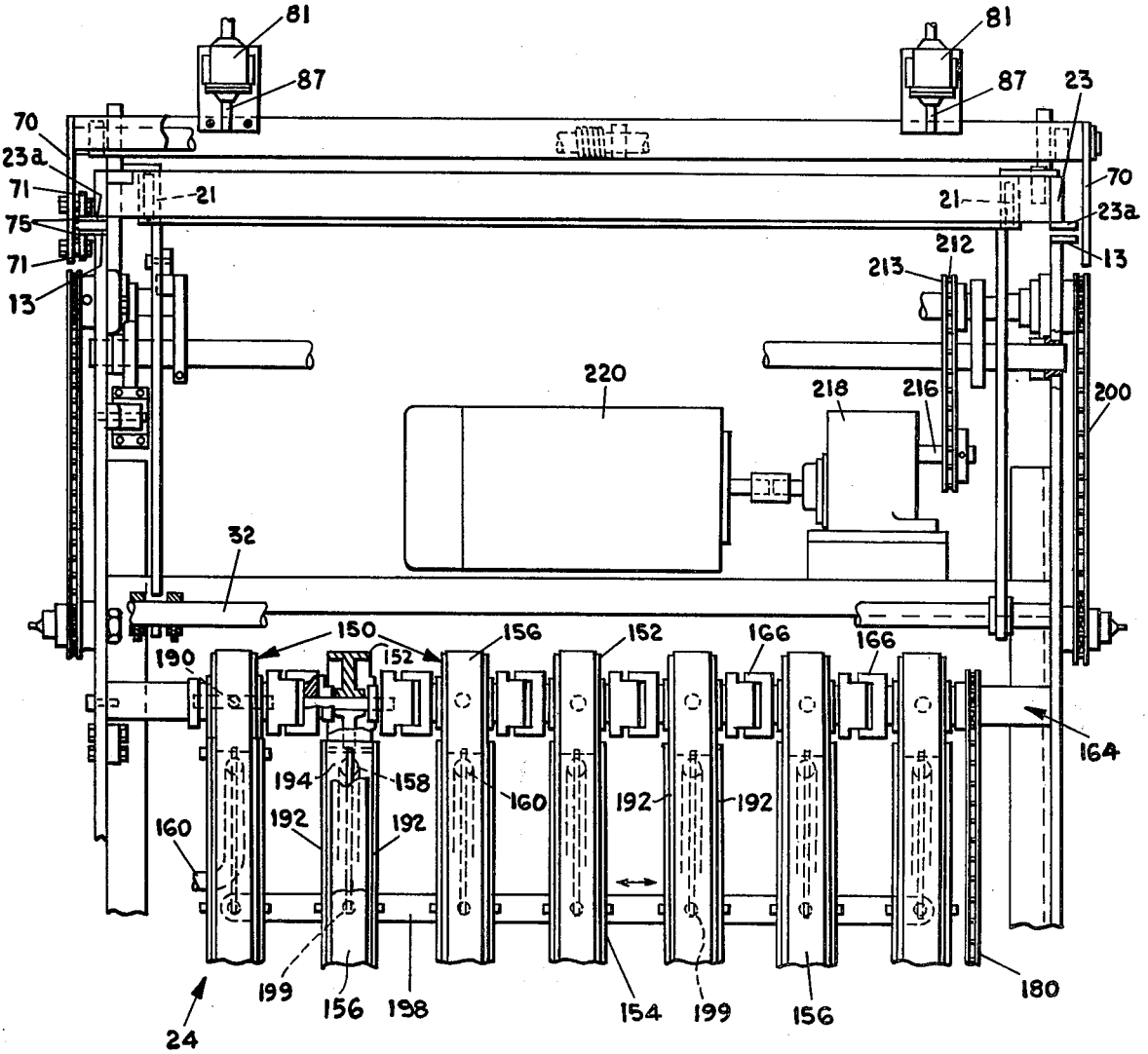
FIG. 2 is an end elevational view of the apparatus in FIG. 1, viewed from the right end of the apparatus as depicted.
Figure 3:
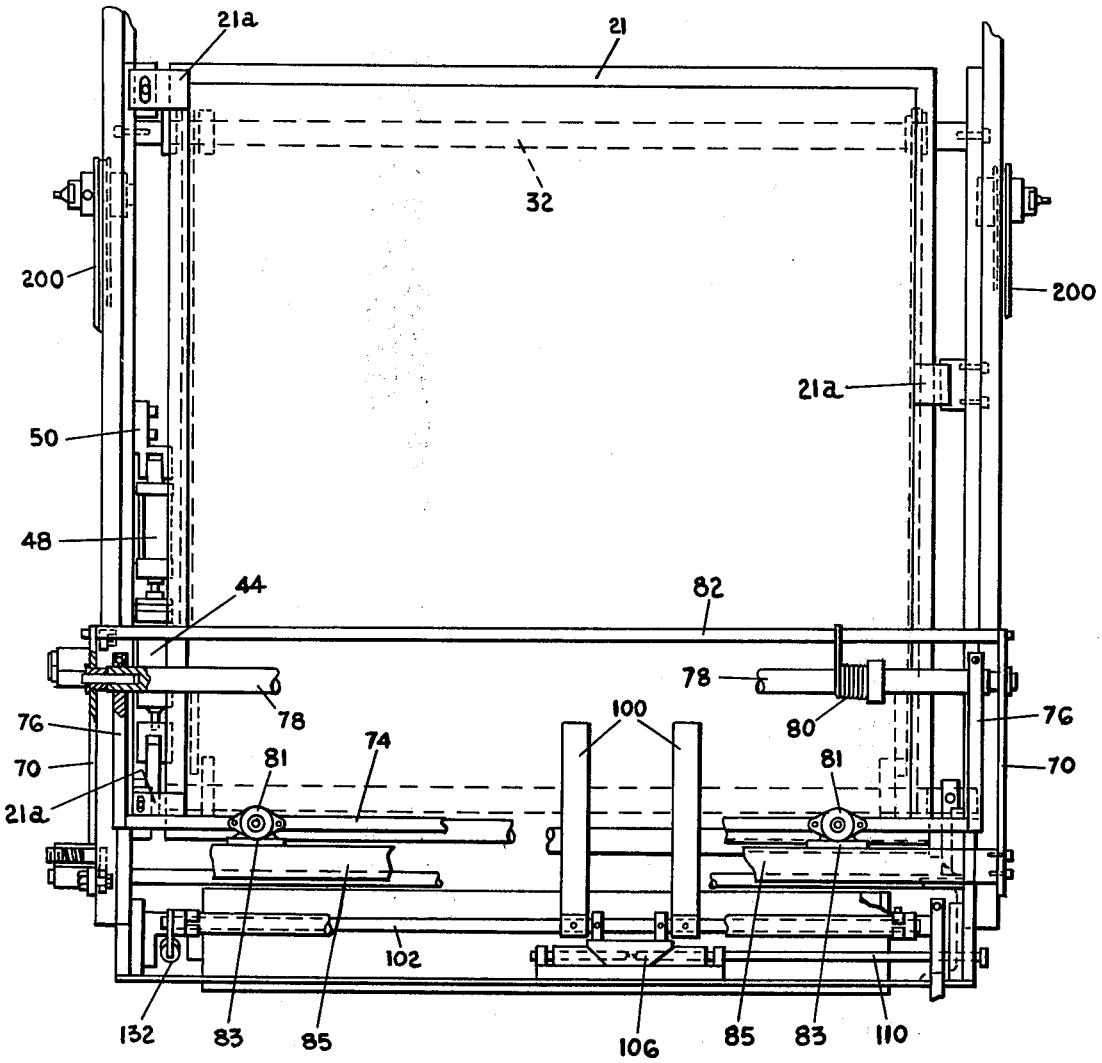
FIG. 3 is a plan view of the apparatus in FIGS. 1 and 2.
Figure 8:
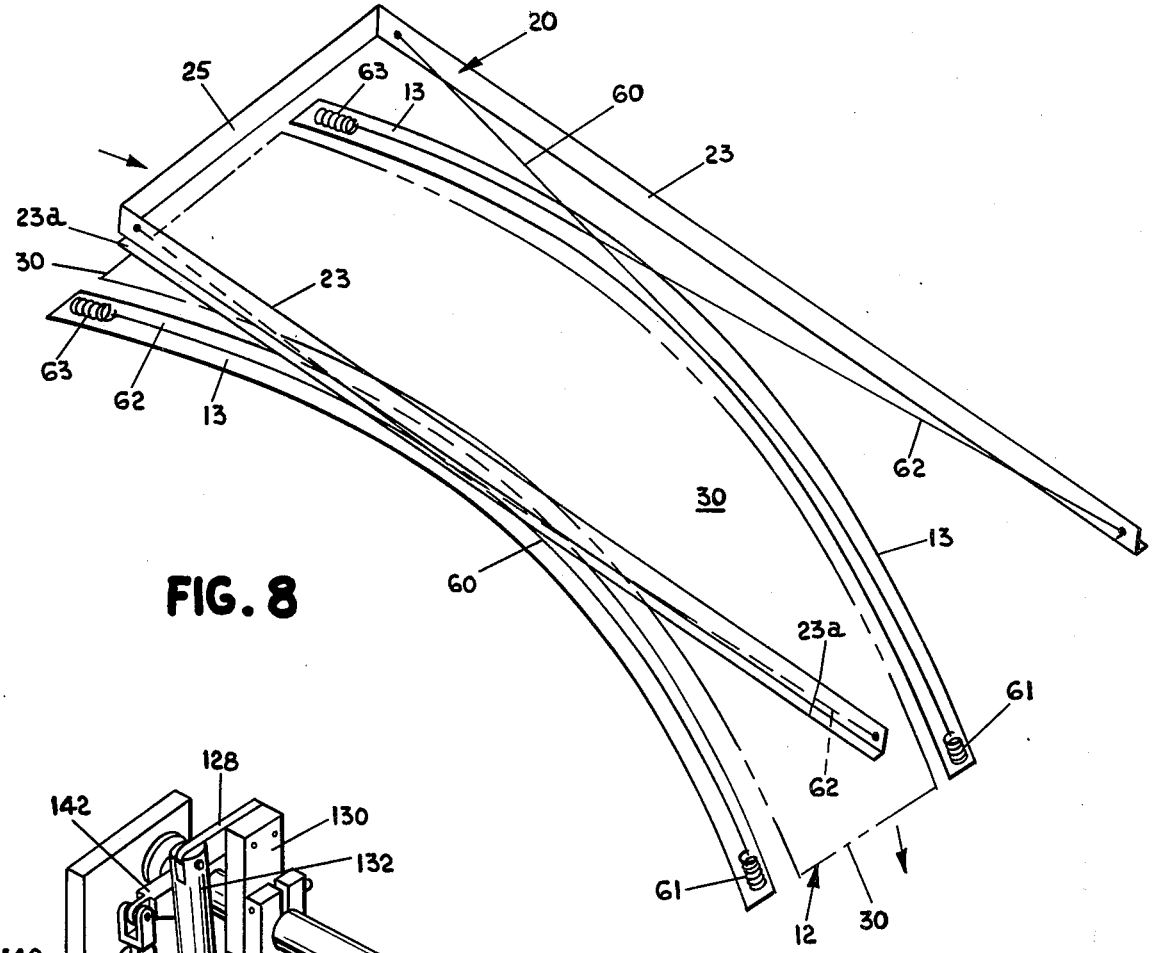
FIG. 8 is a schematic perspective diagram of the print carriage in outline, the fixed guide tracks therefor, and the flexible connectors therebetween.

Stencil screen frame support subassembly 20 is above arcuate bed 12, is generally flat, and is capable of being rocked back and forth over the bed while supporting the removable rectangular stencil screen frame 21 that rocks with it. Support subassembly is basically u-shaped, being formed of a pair of spaced parallel legs 23 interconnected by a corss leg 25 (FIG. 8). Legs 23 have straight flat guide tracks 23*a* (FIGS. 1, 2 and 8) that vertically coincide with and cooperate with arcuate guide tracks 13. Stencil frame 21 has the usual rectangular shape. It is removably supported on subassembly 20 and mounts a printing screen stencil along its bottom plane in conventional fashion. This support of the frame 21 is by way of a plurality (here three) of tabs 21*a* (FIGS. 1 and 2) affixed to stencil frame 21 and projecting laterally over legs 23, two tabs on one side and one on the other (FIG. 3).

Support subassembly 20 is attached to the arcuate underlying tracks 13 by two pairs of flexible tension members, one pair on each side. Specifically one band or cable 60 has one end attached to the upper end of support 20 and the other lower end connected through coil spring 61 to the lower end of one track 13 (FIGS. 1 and 8), while immediately adjacent thereto is a second cable or bank 62 which has its upper end attached through a coil spring 63 to the upper end of track 13 and its lower end attached to the lower end of support 20. A like pair is on the oposite side of the support. The two bands in each pair criss-cross in X fashion and retain the support 20 and tracks 13 in vertically aligned relationship.

Figure 4:
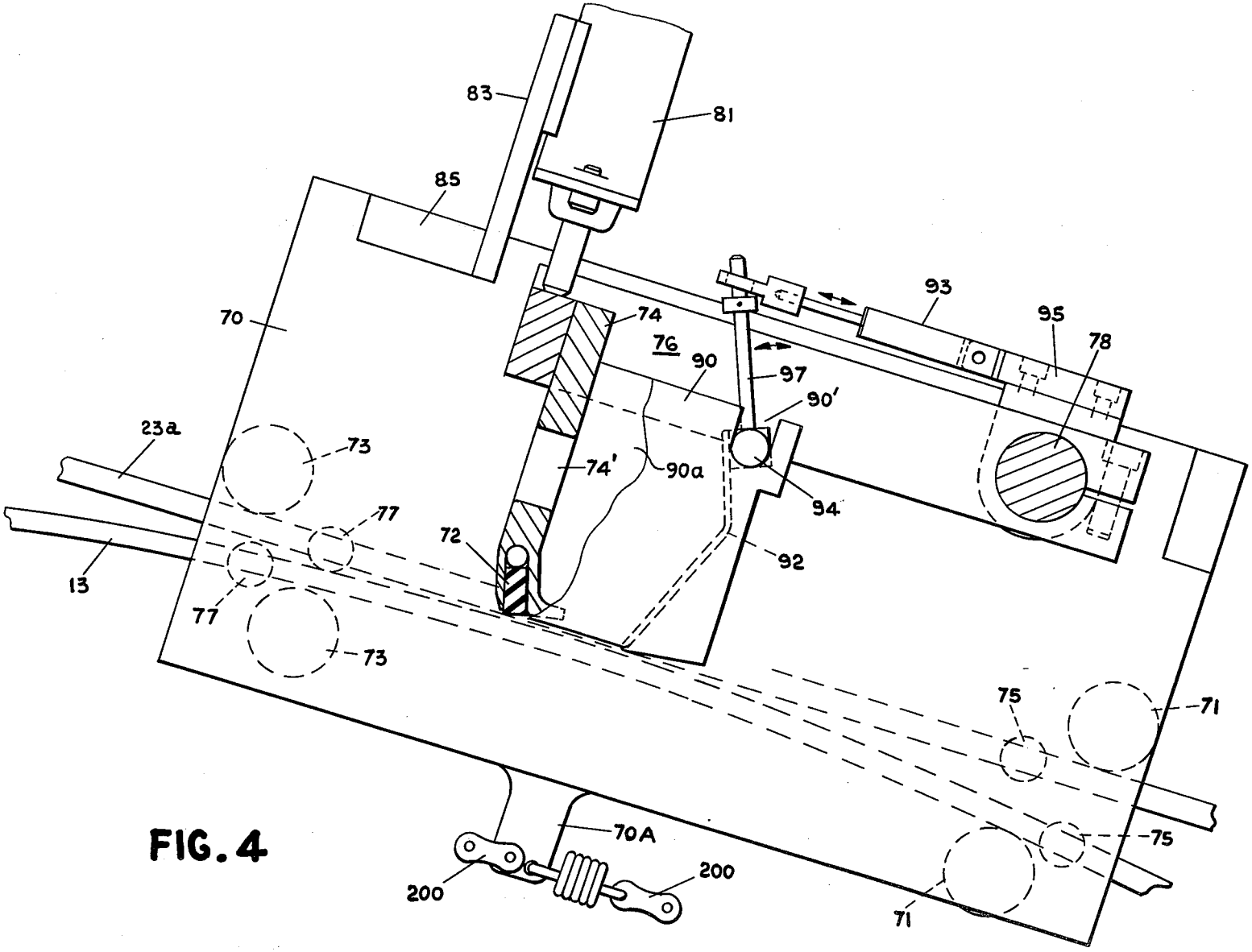
FIG. 4 is a greatly enlarged fragmentary sectional view of the print carriage on the bed, as positioned when part way along a print stroke.

Print carriage subassembly 14 includes a pair of parallel vertical plates 70 (FIGS. 2 and 3) on opposite sides of the printing apparatus which support the squeegee subassembly 16 and also have roller means to follow the curvature of the bed during the forward print stroke and the return of the bed during the forward print stroke and the return back stroke, and to force the stencil supporting fame 20 to rock back and forth (FIGS. 7A–7E). This roller means comprises two pairs of rollers on each plate 70, i.e. two pairs on each side of the printing apparatus. One pair of rollers 71 is at the forward end of the carriage (the right side as depicted in FIG. 4) and the other pair 73 is at the rear end of the carriage (the left side as depicted in FIG. 4). The same is true for the other two pairs on the opposite side. The upper roller in each pair is above the flat track 23*a* of rocking support 20, and the lower roller in each pair is beneath the arcuate track 13, so that these four pairs of rollers cause the support 20 to rock with the advance and return of print carriage 14. Adjacent each pair of these rollers is preferably positioned a set of polymeric rub buttons 75 and 77 to prevent lateral shift of support 20 as it rocks.

Figure 7A:
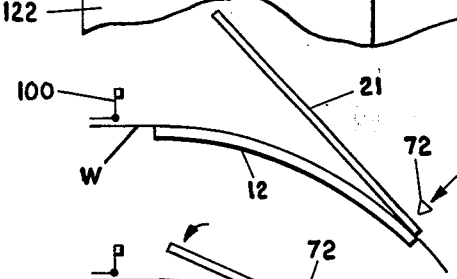
Figure 7B:
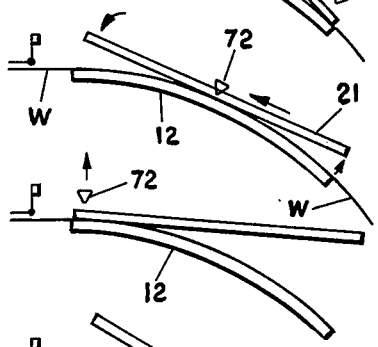
Figure 7C:
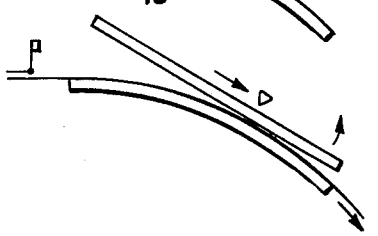
Figure 7E:
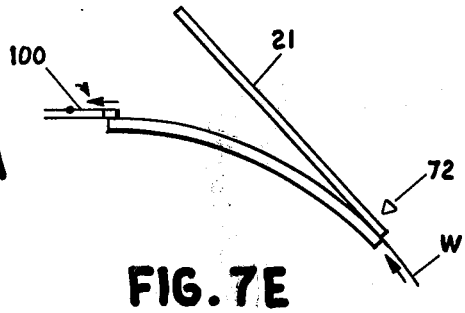

The resilient squeegee blade itself 72 is mounted on the lower end of transverse support 74. The opposite ends of support 74 are secured to a pair of parallel spaced pivot arms 76. These arms are mounted on a transverse pivot shaft 78 rotationally suspended between plates 70 (FIG. 3). Torsion spring 80 wrapped around rod 78 and anchored to transverse bar 82 applies a lifting bias to the squeegee, tending to elevate it away from the web stock surface to be printed. Positioned to counteract the torsion spring 80 on a controlled basis is a pair of vertically oriented fluid cylinders 81 which are mounted by brackets 83 to cross bar 85 affixed to plates 70. The extended piston rods 87 of these cylinders engage the upper edge of plate 74 so that, with power extension of cylinders 81, the squeegee 72 is forcefully depressed to the printing position, (FIG. 7A), while deactivation thereof allows the squeegee to rise away from the stencil screen and stock (FIG. 7C).

The preferred squeegee subassembly forms a controlled ink reservoir between the transversely extending squeegee 72 and adjacent trailing flow coater 92 to contain the ink on the stencil as it tilts to the vertical. Referring to FIG. 4, the elongated plate-like member 74 which supports the squeegee blade 72 has a pair of short vertical plates 90 extending normal thereto at opposite ends thereof. Plates 90 are attached to arms 76. These form end closures for the ink reservoir or chamber 90*a*. The fourth wall of the chamber 90*a* is formed by transverse flow coater blade 92. Flow coater 92 depends from its pivot support 94 that rests in recesses 90' in plates 90. Flow coater 92 can be shifted toward and away from squeegee 74 by air cylinder 93. Cylinder 93 has one end pivotally fixed to a bracket 95 on shaft 78 and its extended piston rod extends around the upper end of upstanding finger 97 secured to and extending radially from pivot support 94. The reservoir 90*a* is open at the top for filling. It can be opened at the bottom to be in communication with the stencil screen mounted in the bottom of the stencil screen frame 21, or closed at the bottom by shifting flow coater 92 into engagement with the bottom of squeegee 74. Squeegee blade 72 is positioned to engage the stencil screen while the trailing lower edge of flow coater blade 92 is spaced a controlled fraction of an inch thereabove. This cooperatively maintains the major ink supply within this reservoir 90*a*, and allows only a controlled thickness of ink to be spread over the stencil screen behind the flow coater blade 92 during the print stroke, to thereby supply a coating of ink on the screen for the next print stroke. Preferably, squeegee support 74 has a series of openings 74' (FIG. 4) therethrough so that excess ink collecting in front of the squeegee on the print stroke will flow back through the squeegee into the ink chamber 90*a* behind the squeegee at the end of the print stroke when the squeegee is brought up to the screen frame at the end of the print stroke.

The print carriage subassembly 14 is advanced and returned by a chain drive arrangement. Specifically, two elongated chains 200 are drivingly attached to the carriage, one on each side thereof. One end of each chain is attached to a depending tab 70A (FIGS. 1 and 4) from the respective plate 70 and the other end of chain 200 is attached through an extensible spring 202 to this tab, enabling the chain 200 to in effect be of variable length as the carriage travels back and forth along the arc of the bed 12. Each chain extends generally the length of the bed and back, around a pair of spaced sprockets 204 and 206. Sprocket 204 is mounted on a transverse shaft 208, as is its like sprocket on the other side. Sprocket 206 is mounted on a transverse shaft 210, as is its like sprocket on the other side. Shaft 208 is rotated by another chain 212 that extends around a second sprocket 213 (FIG. 2) also on shaft 208, and around sprocket 214 on shaft 216, which is the output shaft from gear box 218 driven by motor 220.

This chain drive is driven first in one direction to advance the carriage, and then reversed to return the carriage.

Figure 9:
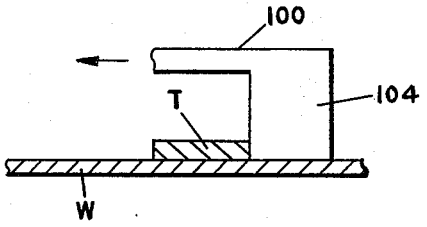
FIG. 9 is a greatly enlarged sectional view of a section of web stock showing the engagement of a registration boss with a tab type protrusion on the web.
Figure 10:
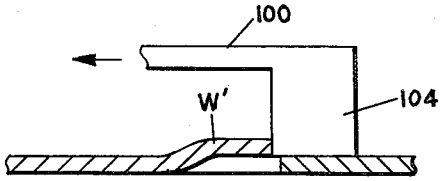
FIG. 10 is a greatly enlarged sectional view of a section of web stock showing the engagement of a registration boss with a die formed type protrusion on the web.

The registration subassembly 18 (FIGS. 1, 6 and 5) employs a pair of spaced registration fingers 100 pivotally mounted on one end of such fingers to a transverse pivot bar 102, each having a downwardly depending engagement boss 104 on the cantilevered free end thereof. These bosses 104 are to engage a pair of spaced protrusions (e.g. T as in FIG. 9 or W′ as in FIG. 10) projecting above the surface of the web W to be printed. These protrusions may be formed by adhering tabs as of paper, plastic, metal or the like, to the web as at T (FIG. 9), or alternatively may be formed into the web itself as by slitting the web and die-forming the portion W′ immediately adjacent the slit to cause the web integral portion to protrude for engagement by bosses 104 as in FIG. 10.

Transverse rod 102 is pivotally mounted at its opposite ends to the lower ends of a pair of suspension links 118, the upper ends of which are fixedly secured to transverse rod 120. Rod 120 is pivotally mounted at its opposite ends to a pair of upright support plates 122 affixed to the frame of the apparatus. Extending from and secured to rod 120 is a right angle bracket composed of elongated members 128 and 130 secured together at one end of each member. The opposite end of member 130 is fixedly secured to rod 120, while the opposite end of member 128 is pivotally connected to a fluid cylinder 132. The opposite end of the fluid cylinder, and specifically the extended piston rod thereof, is pivotally connected to a link 132 extending tangentially of rod 102. Extension of cylinder 132 therefore rotates rod 102 (counterclockwise as viewed in FIG. 5) to cause registry fingers 100 to be pivotally raised, while contraction of cylinder 132 causes rotation of rod 102 in the opposite direction to cause fingers 100 to be lowered into engagement with the web stock thereunder. This subassembly 18 also has a second fluid cylinder 140, one end of which is affixed to support 122. The upper end is pivotally attached to one end of a link 142 which is connected to rod 120 on the opposite end of the link, so that the link 142 extends radially of the rod 120. Extension of cylinder 140 causes the registry fingers 100, when lowered to the web stock W, to be retracted back toward rod 102 until the annular stops 144 on rod 102 engage the face of adjustable stop member 106. Likewise, contraction of cylinder 140 causes rod 120 to rotate in the counterclockwise direction as viewed in FIG. 5, pivoting the radial arms 118 in a counterclockwise direction to extend fingers 100 away from stop 106.

The stopping position for fingers 100, when retracted by cylinder 140 can be varied to achieve desired exact registration of the web stock W for printing. This is achieved by adjusting abutment 106 longitudinally of the web stock, i.e. toward or away from fingers 100. Abutment 106 has a pair of diagonally sloped rear faces which engage a pair of similarly sloped straddling wedge elements 103. Elements 108 are threadably mounted on adjustment shaft 110, with threads of opposite hand, so that rotation of shaft 110 moves elements 108 toward or away from each other and abutment 106. Elements 108 are slidably supported on a plate 114 secured to a longer plate 116, in turn secured to supports 122. Shaft 110 is rotationally supported in bearings 115 attached to plate 114, extends through one of supports 122 and has a knob 112 for rotational adjustment thereof. Abutment 106 is slidably retained between elements 108 as by tongue and groove arrangement.

At the lower, web discharge end of bed subassembly 12 is web advancing subassembly 24. This subassembly 24 comprises a series of parallel driven vacuum belt units 150 (FIG. 2). Each vacuum belt unit includes a pair of spaced pulleys 152 and 154 about which a perforated belt 156 recirculates. Portions of each belt 156 continuously pass over a vacuum manifold chamber 158 (FIG. 1) between pulleys 152 and 154. Chamber 158 is communicative through conduit 160 with a vacuum source (not shown) such as a conventional pump and reservoir arrangement. The entire series of pulleys 152 for each of the units 150 are coaxially mounted on drive shaft subassembly 164 which includes a series of universal joints 166 between units 150. These joints 166 may be what are commonly called slider couplings or Oldham couplings. This series of pulleys and their universal joints are rotationally driven from motor and gear box unit 170, which drives sprocket 172, to drive chain 174, which in turn drives a double sprocket arrangement 176 on shaft 178, to drive chain 180, which in turn drives sprocket 182 on the drive shaft assembly 164.

Each of the vacuum belt units 150 includes a support assembly which is pivotally mounted on a pin 190 (FIG. 1) adjacent pulley 152 on each unit. Each such support assembly includes a pair of spaced parallel belt straddling plates 192 (FIG. 2) which mount the lower pulley 154 therebetween, and an underlying transverse plate 194 (see FIG. 1) between plates 192 extending up alongside pulley 152 for pivotal connection to pin 190. In FIG. 2, the upper portion of the belt 156 on the second unit from the left has been cut away to show the plate 194, the plates 192, and the upper pulley 152. Also pivotally secured to each of plates 194 of units 150 by pivot pins 199 (FIGS. 1 and 2) is a transverse shifting linkage 198 which underlies all of the units adjacent pulleys 154. With this arrangement, the series of belt units 150 effectively form a series of parallelogram linkages, with adjacent belt units forming the parallel legs of the linkage and the universal joint drive shaft arrangement 164 and adjustment link 198 forming the other transverse parallel legs. By transversely shifting linkage 198 in one direction or the opposite direction therefore, the angular orientation of the series of parallel belts relative to bed 12 can be varied to control the angular direction of advance of the web stock feeding across the vacuum belts from the bed 12. The control system for this can be automatic if desired by the use of suitable sensors for the edges of the web, e.g. of the type described relative to FIG. 2 in U.S. Pat. No. 3,679,112.

OPERATION

FIGS. 7A–7E schematically depict the sequential steps of operation during functioning of the apparatus described above. Assuming that a portion of the generally continuous web stock W is in registry on the curved bed 12, that the bed is in the elevated print position, and that the print carriage is at the lower right-hand end of the structure depicted in the drawings to cause the stencil frame 21 to be tilted or rocked to its most vertical condition, the squeegee 72 is then lowered into engagement with the stencil screen on the bottom plane of frame 21 and into operative printing relationship with a web W on bed 12. This lowering of squeegee 72 is by extension of air cylinders 81 (FIG. 6) to depress arms 76 and support 74 along with squeegee 72 against the bias of the elevating springs 80. The carriage, along with the squeegee assembly retained therein, is then advanced arcuately uphill i.e. to the left as depicted, by its chain drive, causing frame 21 to gradually tilt toward the horizontal, causing squeegee 72 to engage successive areas of the stencil screen to print successive portions of the web W by causing ink to flow through the stencil, and causing successive portions of the stencil screen to be immediately raised away from freshly printed areas of the web, (FIG. 7B) until the squeegee 72 reaches the upper end of the bed 12. As the carriage advances during the print stroke, flow coater 92 is spaced from the squeegee as in FIG. 4, by extension of cylinder 93, to allow ink to be in contact with the stencil screen. The advancing flow coater 92 therefore spreads a new coat of ink on the screen behind the squeegee. When the squeegee reaches the upper end, as in FIG. 7C, the excess ink ahead of it is trapped between the squeegee and the end of the stencil frame 21 and is thereby forced to flow through the squeegee 72 into the reservoir 90*a*. The flow coater is shifted by cylinder 93 to a closed position against the squeegee 72, the squeegee and flow coater subassembly 16 is elevated, bed 12 is lowered, and the carriage and squeegee subassemblies 14 and 16 are returned back to the right toward the lower end of the bed. The elevated returning squeegee 72 thus does not contact the stencil to disturb the ink therein on this return stroke and the ink is kept from flowing out of the reservoir 90*a*. Further, the lowered bed 12 prevents the stencil from contacting the freshly printed web stock W as the stencil frame is tilted back, as well as allowing the web stock to be advanced without the freshly printed surface engaging the screen. This lowering of bed 12 is achieved by actuation of cylinder 48 to shift support elements 34 (FIG. 1) to the right as depicted, allowing the bed 12 to pivot downwardly around its lower pivot shaft 32.

As the elevated squeegee 72 is returned with the carriage to the lower right-hand position, the web stock W is advanced (FIG. 7D) by activation of the vacuum belt units 150. These units are oriented in the desired angular relationship relative to the bed 12 to maintain the web W on the bed in exactly controlled lateral position. Suitable sensing means such as a conventional vacuum orifice sensor or limit switch or other edge sensing means for the web W may be employed on each side of the web, to control the angular relationship of the group of vacuum belts 156 by transversely shifting link 198 (FIGS. 1 and 2) a controlled amount. The web stock is so advanced by the vacuum belts 156 slightly past a fraction of an inch past the final registration position of the stock for the next print stroke and then it stops.

Figure 5:
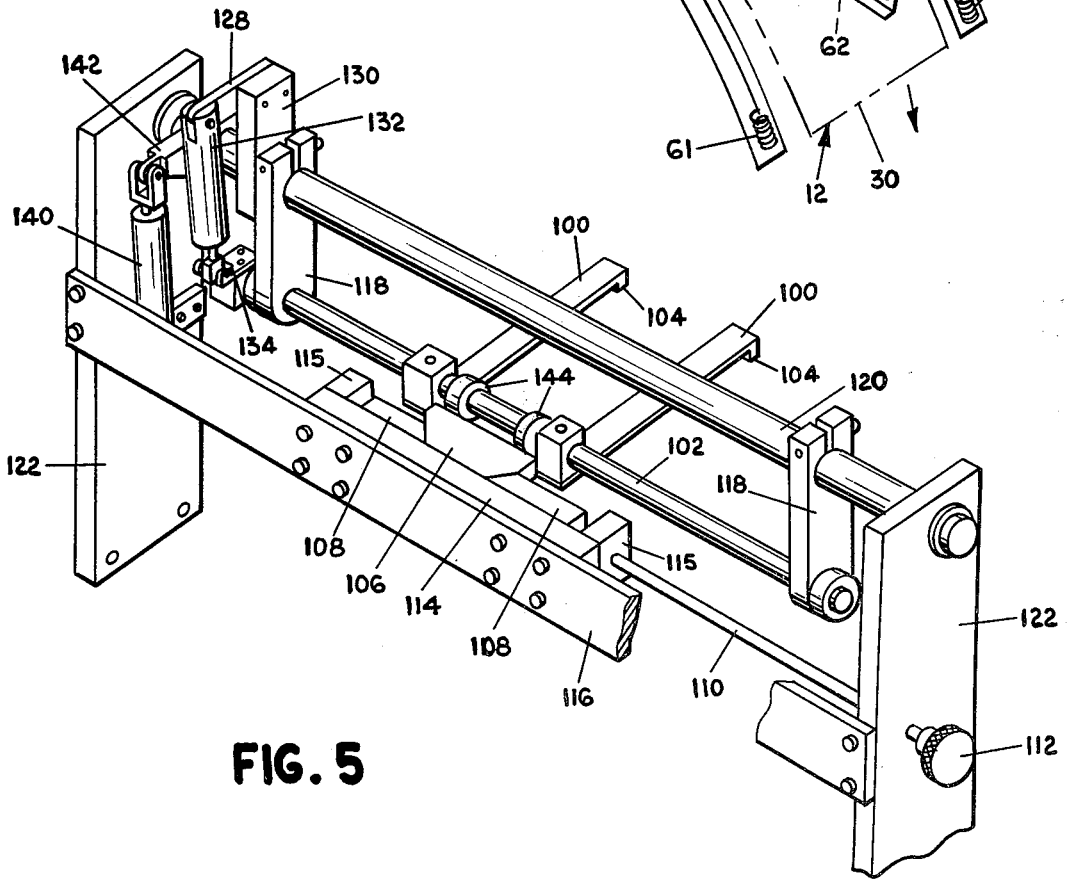
FIG. 5 is a fragmentary perspective view of the registration means for the apparatus.
Figure 6:
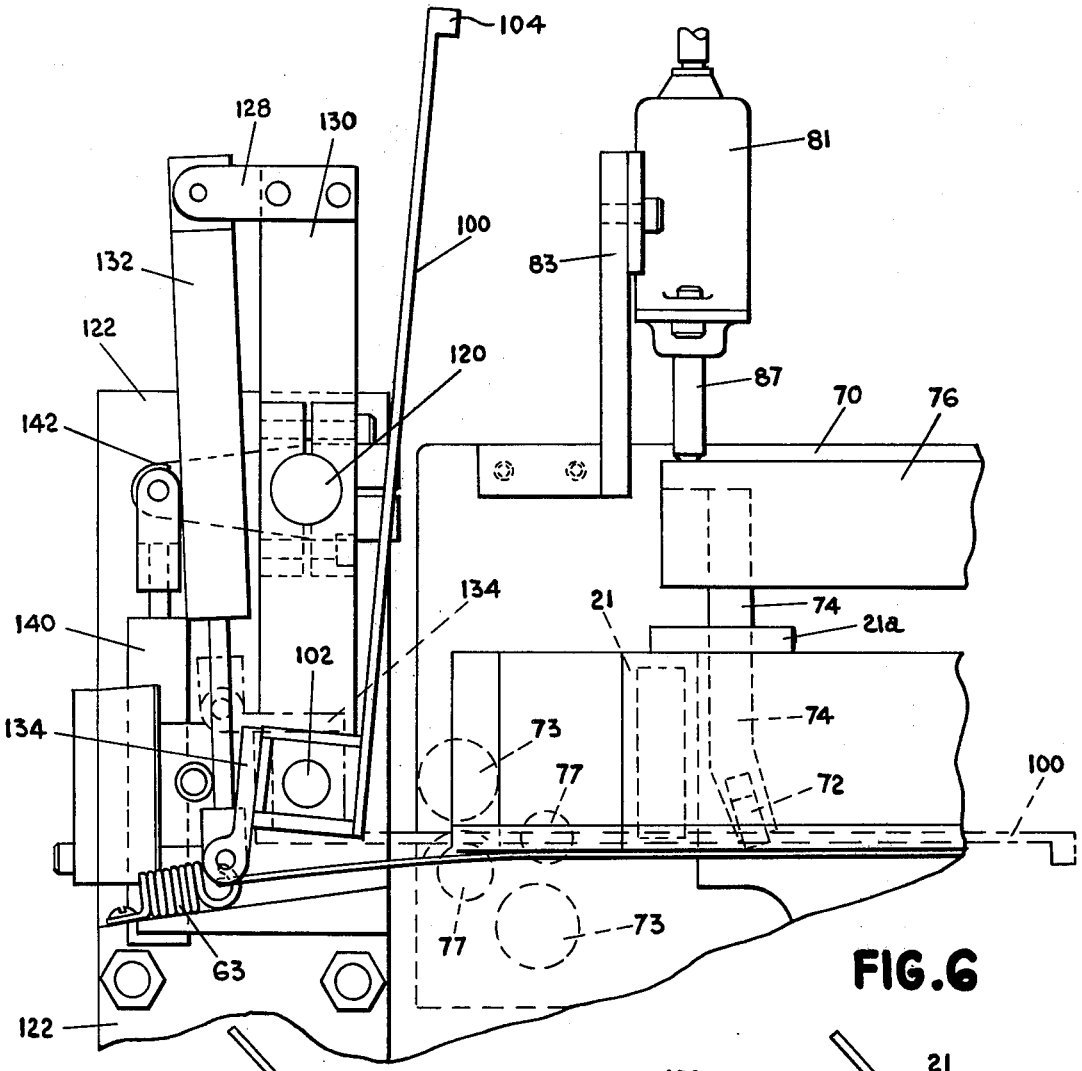
FIG. 6 is an enlarged fragmentary side elevational view of the upper left hand portion of FIG. 1.

As soon as the carriage reaches its start position, bed 12 is again elevated (FIG. 7E) and registration fingers 100 are pivotally lowered by retraction of cylinder 132 (FIG. 5) so that bosses 104 engage the web. The registration fingers 100 are then pulled back a slight amount toward the infeed end of the bed by extension of cylinder 140 (FIG. 5) to cause bosses 104 to engage the forward edges of the spaced protrusions on the web, e.g. added tabs T (FIG. 9) or offset portions W′ of the web itself (FIG. 10), and retract the web a controlled fraction of an inch by pulling the protrusions with the bosses 100 until annular stops 144 strike fixed stop 106 (FIG. 5). The web is then in registry, fingers 100 are elevated to a retracted position (FIG. 6), and the squeegee 72 is lowered for the next print stroke as explained relative to FIG. 7A. The vacuum belts or tapes 156 hold the web in registry as the squeegee moves away from the tapes. This sequence is then repeated time and again to print repeat sections of the web stock being advanced through the assembly.

Several additional advantages and features of the instant apparatus may be readily apparent to those in the art upon studying the detailed disclosure of this preferred embodiment of the invention. It is entirely possible to modify certain details of the apparatus within the concept presented in order to suit a particular type of installation. Therefore, it is intended that the scope of the invention is to be limited only by the appended claims and the reasonably equivalent structures to those defined therein, rather than to the details of the preferred embodiment set forth as illustrative of the invention.

The embodiments of the invention in which an exclusive property or privilege is claimed are defined as follows:

1. A web stock stencil printer having a curved, stock support bed, a stencil screen frame support rockable on said bed, and print carriage means for rocking said stencil screen frame support on said stock support bed, said print carriage means being reciprocally movable in a print stroke and in a return stroke along said bed, said print carriage means being operably coupled to said frame support to rock said frame support over said bed in a first direction during the print stroke, and rock it in the opposite direction during the return stroke; said bed having a web stock inlet end, and a web stock outfeed end; means to intermittently shift said bed and said stencil screen frame support apart after the print stroke for enabling web stock to be advanced around said curved bed free from interference with a stencil and stencil frame in said stencil frame support; a squeegee shiftable on said carriage means between a print position and a non print position relative to said frame support and said bed; shifting means connected to said squeegee for shifting said squeegee from said print position to said non print position; a squeegee trailing flow coater means spaced from said squeegee for spreading a coating of ink on the stencil in said stencil support frame, and end panels extending between said squeegee and said flow coater means, to cause said squeegee, flow coater means, and end panels to form an open bottom ink reservoir; said squeegee having a front face and openings from said front face, through said squeegee and into said reservoir, to allow excess ink in front of said squeegee to flow back into said reservoir.

2. A web stock stencil printer having a curved stock support bed, a stencil screen frame support rockable on said bed, and print carriage means for rocking said stencil screen frame support on said stock support bed, said print carriage means being reciprocally movable in a print stroke and in a return stroke along said bed, said print carriage means being operably coupled to said frame support to rock said frame support over said bed in a first direction during a print stroke, and rock it in the opposite direction during a return stroke; intermittent web stock advancing means adjacent said bed for advancing the web stock; web registry means for registration of the web stock; said bed being shiftable relatively toward said frame support for the print stroke and away from said frame support for the return stroke and web stock advancement; a squeegee supported by said print carriage means to travel therewith; said squeegee being shiftable between a lowered print position during the print stroke and an elevated position during the return stroke; said bed having web infeed end and a printed web outfeed end; said web stock advancing means comprising a series of powered vacuum belt units at said outfeed end in parallel relationship to each other; said vacuum belt units being interconnected on shiftable parallelogram linkage to regulate angular directional web stock movement relative to said bed during advancement of the web stock over the bed, one leg of said linkage comprising a series of universal joints to enable said vacuum belt units to remain in parallel relationship.

* * * * *

UNITED STATES PATENT AND TRADEMARK OFFICE

CERTIFICATE OF CORRECTION

PATENT NO. : 3,973,490

DATED : August 10, 1976

INVENTOR(S) : James A. Black

It is certified that error appears in the above-identified patent and that said Letters Patent are hereby corrected as shown below:

Column 3, line 9:

Omit ---and 44 48---

Column 3, line 10:

After "cylinders" insert ---48 and 44---

Column 3, line 31:

"corss" should be ---cross---

Column 8, line 20:

"100" should be ---104---

Signed and Sealed this

Twenty-third Day of November 1976

[SEAL]

*Attest:*

RUTH C. MASON
*Attesting Officer*

C. MARSHALL DANN
*Commissioner of Patents and Trademarks*